US007966843B2

(12) United States Patent
Lee et al.

(10) Patent No.: US 7,966,843 B2
(45) Date of Patent: Jun. 28, 2011

(54) COOL AIR SUPPLYING APPARATUS AND REFRIGERATOR HAVING THE SAME

(75) Inventors: Soo-Kwan Lee, Seoul (KR); Jun-Ho Bae, Seoul (KR); Chang Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 168 days.

(21) Appl. No.: 11/714,244

(22) Filed: Mar. 6, 2007

(65) Prior Publication Data

US 2007/0266729 A1 Nov. 22, 2007

(30) Foreign Application Priority Data

May 19, 2006 (KR) ..... 10-2006-0045314

(51) Int. Cl.
*F25D 17/06* (2006.01)

(52) U.S. Cl. ..... 62/419; 62/426

(58) Field of Classification Search ..... 62/416, 62/419, 414, 426

See application file for complete search history.

(56) References Cited

U.S. PATENT DOCUMENTS

| | | | | |
|---|---|---|---|---|
| 3,609,988 | A * | 10/1971 | Bright | 62/187 |
| RE27,990 | E * | 4/1974 | Rivard et al. | 62/419 |
| 5,967,764 | A * | 10/1999 | Booth et al. | 417/423.8 |
| 2006/0070395 | A1 * | 4/2006 | Lee et al. | 62/408 |

FOREIGN PATENT DOCUMENTS

| | | |
|---|---|---|
| CN | 1204040 | 1/1999 |
| JP | 64048569 | 3/1989 |
| JP | H01-178573 | 12/1989 |
| JP | 09-229532 | 9/1997 |
| JP | 2001-153525 | 6/2001 |
| JP | 2001-244110 | 9/2001 |
| JP | 2002-062017 | 2/2002 |
| JP | 2003-009470 | 1/2003 |

OTHER PUBLICATIONS

Chinese Office Action dated Apr. 18, 2008.
Japanese Office Action dated Mar. 24, 2009.
U.S. Office Action dated Mar. 14, 2011 from related U.S. Appl. No. 11/714,236 filed Mar. 6, 2007.

* cited by examiner

*Primary Examiner* — Frantz F Jules
*Assistant Examiner* — Cassey Bauer
(74) *Attorney, Agent, or Firm* — KED & Associates LLP

(57) ABSTRACT

A cool air supplying apparatus is provided for a refrigerator. The cool air supplying apparatus includes a box fan motor integrally having a fan that blows cool air generated by an evaporator to a freezing chamber or a refrigerating chamber and a motor that drives the fan, a first passage that supplies cool air generated from the evaporator to the box fan motor, and a second passage that supplies cool air blown by the box fan motor to the freezing chamber or the refrigerating chamber. Since the box fan motor does not interrupt a cool air passage, energy loss may be decreased. Further, since the motor does not protrude towards the inside of the refrigerator, a capacity volume of the refrigerator may be increased.

23 Claims, 5 Drawing Sheets

COOL AIR SUPPLYING APPARATUS AND REFRIGERATOR HAVING THE SAME

The application claims priority to Korean Application No. 10-2006-0045314, filed on May 19, 2006, which is herein expressly incorporated by reference in its entirety.

BACKGROUND

1. Field

A refrigerator, and more particularly, a cool air supplying apparatus for a refrigerator are disclosed herein.

2. Background

Reducing energy loss, and increasing efficiency and capacity are important and desirable in the art of refrigerators.

BRIEF DESCRIPTION OF THE DRAWINGS

The embodiments will be described in detail with reference to the following drawings in which like reference numerals refer to like elements and wherein.

DETAILED DESCRIPTION

Generally, a refrigerator is provided with an inner space including a refrigerating chamber and a freezing chamber partitioned by a partition wall. The freezing chamber is maintained at a low temperature so as to keep items stored therein, such as food, in a frozen state. The refrigerating chamber keeps items stored therein, such as food, fresh but not frozen.

Figure 1:
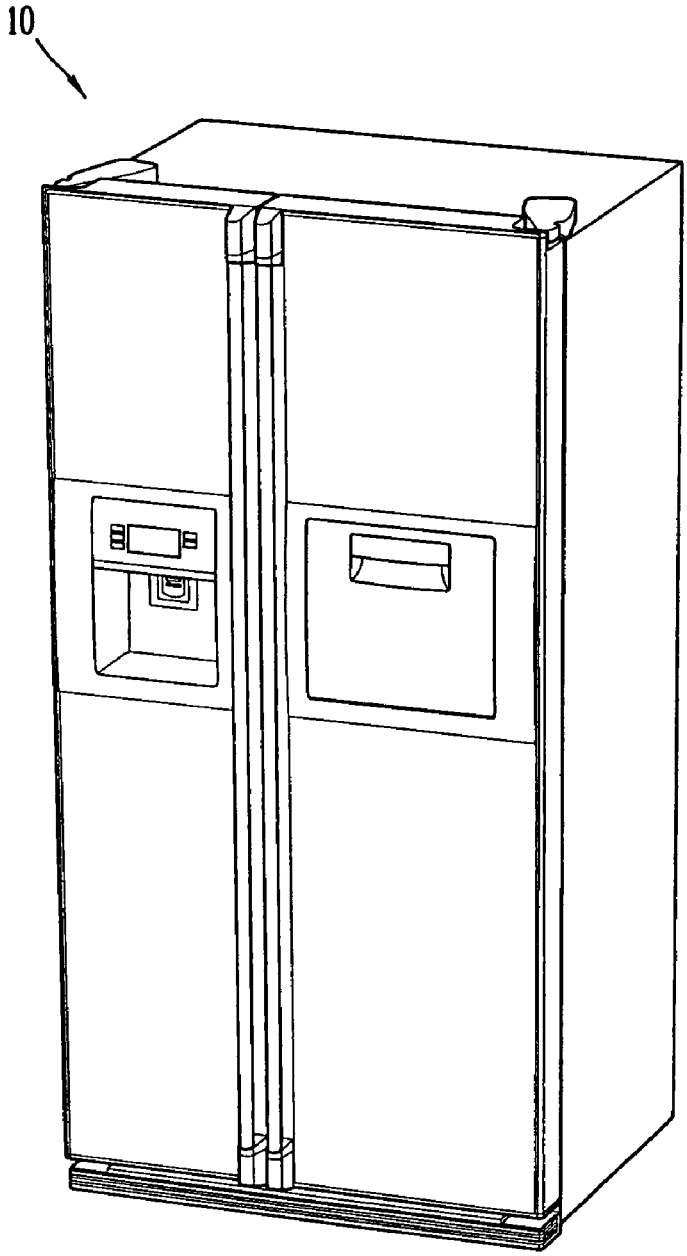
FIG. 1 is a front perspective view of a refrigerator according to an embodiment.
Figure 2:
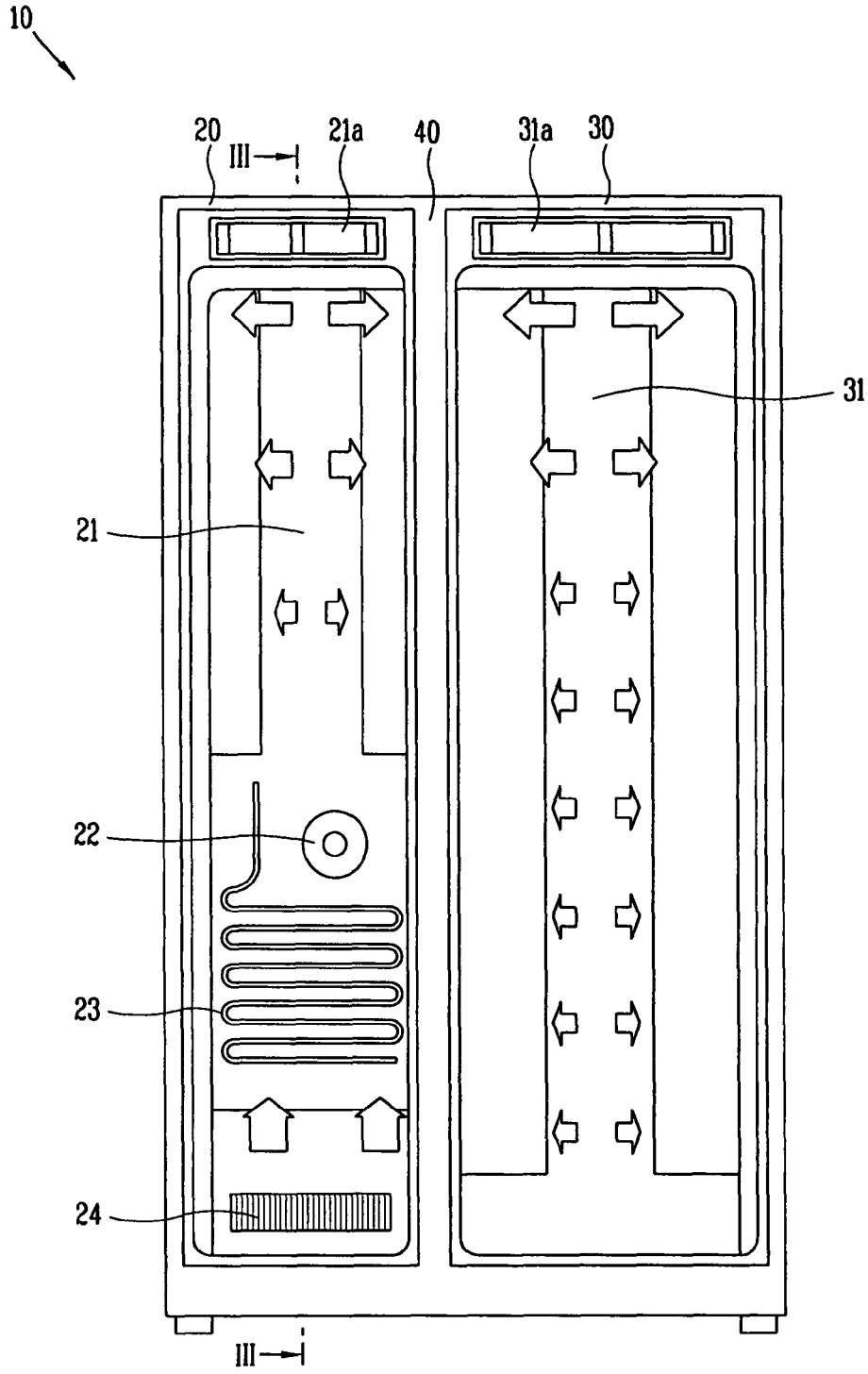
FIG. 2 is a rear view of a cool air supplying apparatus for a refrigerator in accordance with an embodiment.
Figure 3:
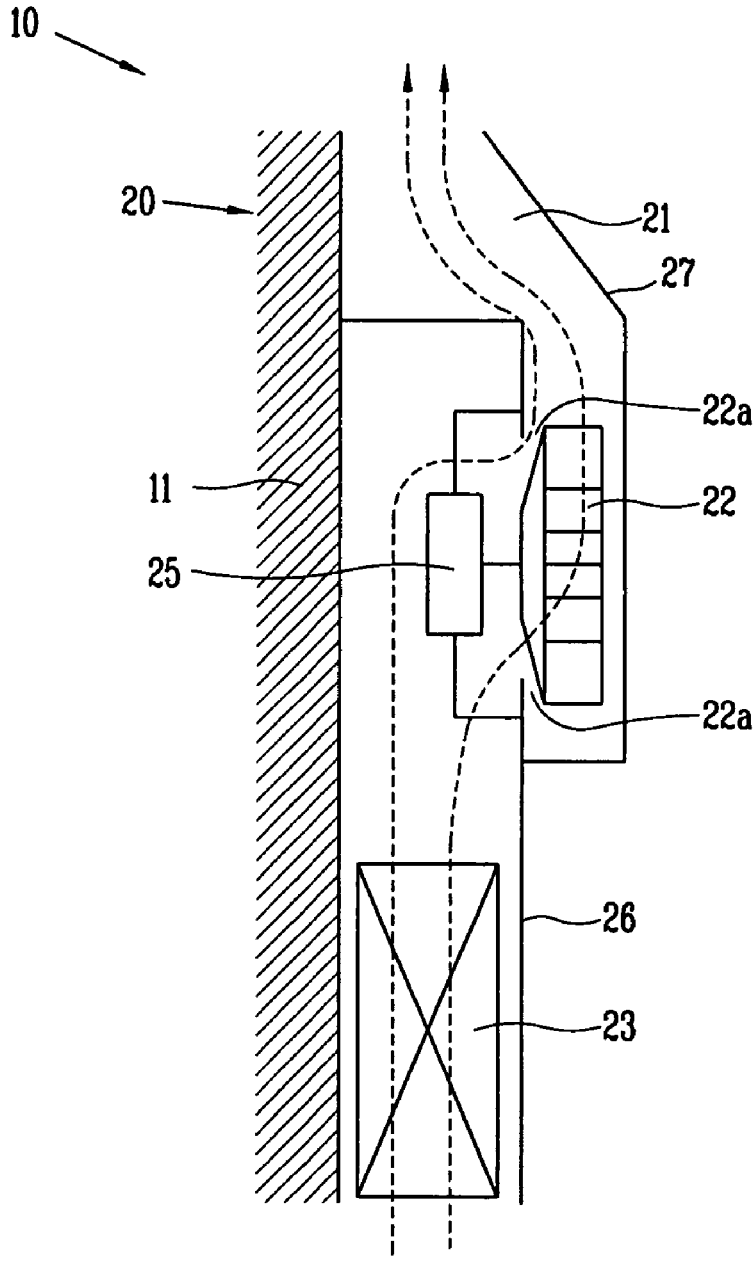
FIG. 3 is a sectional view taken along line 'III-III' of FIG. 2.

Hereinafter, a cool air supplying apparatus for a refrigerator according to an embodiment will be explained with reference to FIGS. 1-3. FIG. 1 is a front perspective view of a refrigerator according to an embodiment. FIG. 2 is a sectional view of a cool air supplying apparatus for a refrigerator 10 in accordance with an embodiment. FIG. 3 is a sectional view taken along line 'III-III' of FIG. 2.

As shown in FIGS. 1-3, a cool air inlet 24 is provided at a lower portion of a freezing chamber 20 through which increased temperature cool air passes which has performed a cooling operation by circulating through the freezing chamber 20 and a refrigerating chamber 30 (divided from each other by a partition wall 40). An evaporator 23 that heat-exchanges the increased temperature cool air to generate lowered temperature cool air is disposed above the cool air inlet 24. A first cover 26 which receives the evaporator 23 therein is disposed adjacent the evaporator 23. A cool air passage is formed between the first cover 26 and a rear wall 11 of the refrigerator.

A fan 22 that blows cool air generated by the evaporator 23 is disposed above the evaporator 23. A second cover 27 having a cool air passage for introducing cool air blown by the fan 22 to a cool air duct 21 is disposed outside the fan 22. The fan 22 is driven by a motor 25, and is installed in a guide (not shown).

The first cover 26 is provided with an orifice 22*a* for blowing cool air to the fan 22. The orifice 22*a* is formed in the first cover 26 so as to be positioned between the motor 25 and the fan 22.

Since the fan 22 and the motor 25 are disposed to face each other with respect to the orifice 22*a*, the second cover 27 protrudes towards the freezing chamber 20 more than the first cover 26. That is, the second cover 27 is farther separated from the rear wall 11 than the first cover 26. Further, the evaporator 23 and the fan 22 are installed only in the freezing chamber 20.

The cool air duct 21, which supplies lowered temperature cool air that has passed through the evaporator 23 to the freezing chamber 20, is formed above the fan 22. A plurality of cool air outlets 21*a* that discharge cool air into the freezing chamber 20 are formed in the cool air duct 21. A single cool air duct 21 is installed along the rear wall 11 of the freezing chamber 20.

One cool air duct 31 is installed along the rear wall 11 of the refrigerating chamber 30 so as to communicate with the cool air duct 21 of the freezing chamber 20. A plurality of cool air outlets 31*a* that discharge cool air into the refrigerating chamber 30 are formed in the cool air duct 31 of the refrigerating chamber 30.

An operation of the refrigerator 10 of FIGS. 1-3 having the cool air supplying apparatus described above will be explained hereinafter.

When the refrigerator 10 is operated, a compressor (not shown) is operated to cool the evaporator 23. The motor 25 is driven to circulate cool air in the refrigerator 10.

Increased temperature cool air introduced to the cool air inlet 24 provided at a lower portion of the evaporator 23 passes through the evaporator 23 installed in the first cover 26, and then is heat-exchanged. The increased temperature cool air is converted into lowered temperature cool air, and then is introduced to the fan 22 through the orifice 22*a*. Most of the cool air discharged from the fan 22 is supplied to the freezing chamber 20 through the cool air duct 21. Some of the cool air is supplied to the refrigerating chamber 30 through the cool air duct 31. As the cool air repeatedly flows, the freezing chamber 20 and the refrigerating chamber 30 are cooled.

Cool air generated from the evaporator 23 passes through a passage formed by the rear wall 11 and the first cover 26 of the freezing chamber 20, and then is introduced into the fan 22 via the orifice 22*a*. The cool air is introduced into the orifice 22*a* around a peripheral portion of the motor 25, as shown in FIG. 3. The cool air introduced into the fan 22 is introduced into the cool air duct 21 along a passage formed by the rear wall 11 and the second cover 27. The dotted line arrow shown in FIG. 3 denotes a flowing direction of cool air.

However, the refrigerator 10 of FIGS. 1-3 has at least the following problems. Since the orifice 22*a* is formed in the first cover 26 so that the motor 25 and the fan 22 face each other, the motor 25 interrupts the cool air passage. Accordingly, energy loss due to passage resistance occurs. Further, since cool air flows around a peripheral portion of the motor 25, the passage channel is long.

Further, if the motor 25 is installed to be separated from the orifice 22 by increasing an axial length of the motor 25, a distance between the motor 25 and the fan 22 is increased. Accordingly, vibration and noise generated as the fan 22 is driven are transmitted outwardly. Also, since the second cover 27 is farther separated from the rear wall 11 than the first cover 26, a capacity of the refrigerator is decreased.

Figure 4:
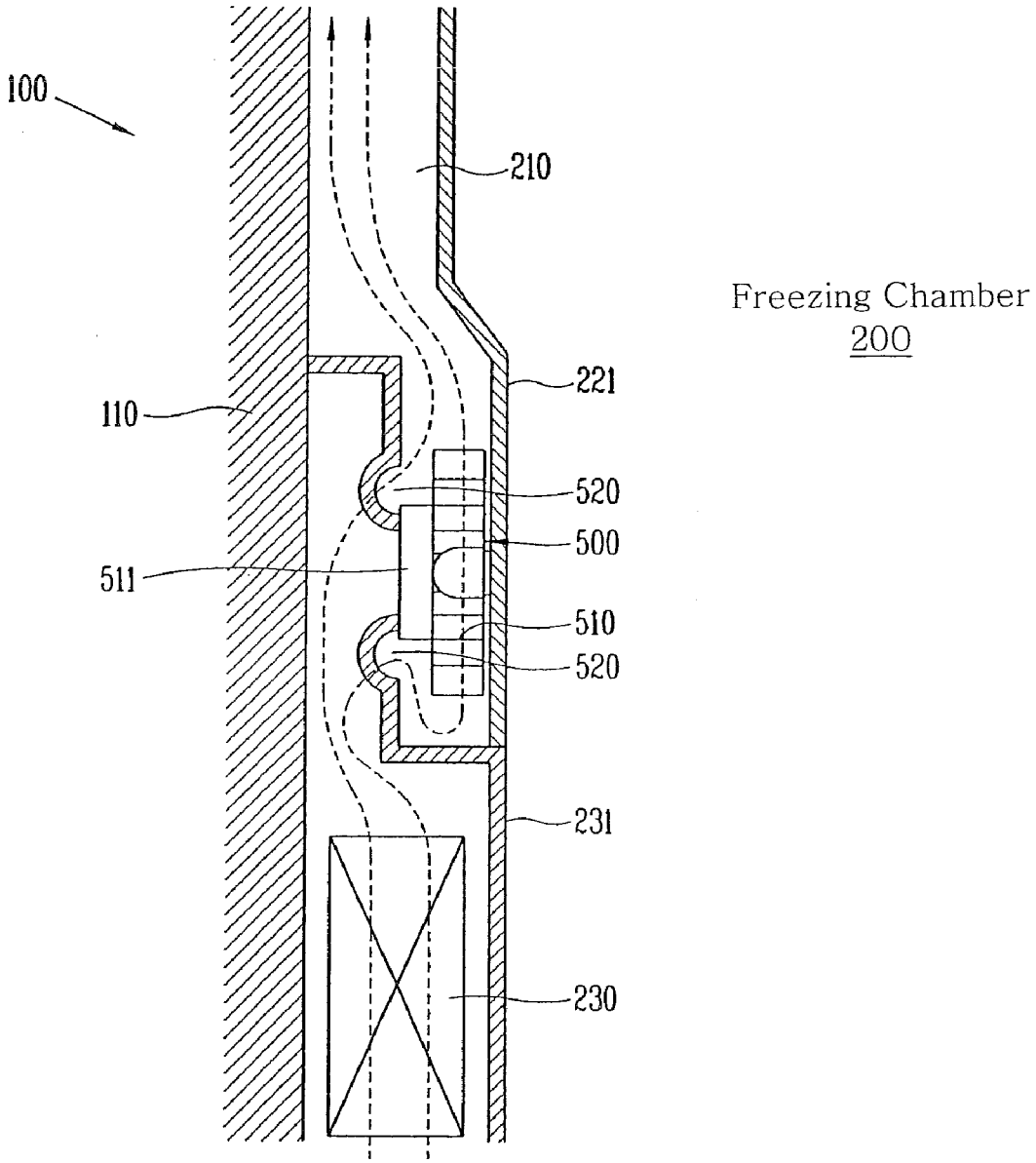
FIG. 4 is a lateral section view of a cool air supplying apparatus for a refrigerator according to another embodiment.
Figure 5:
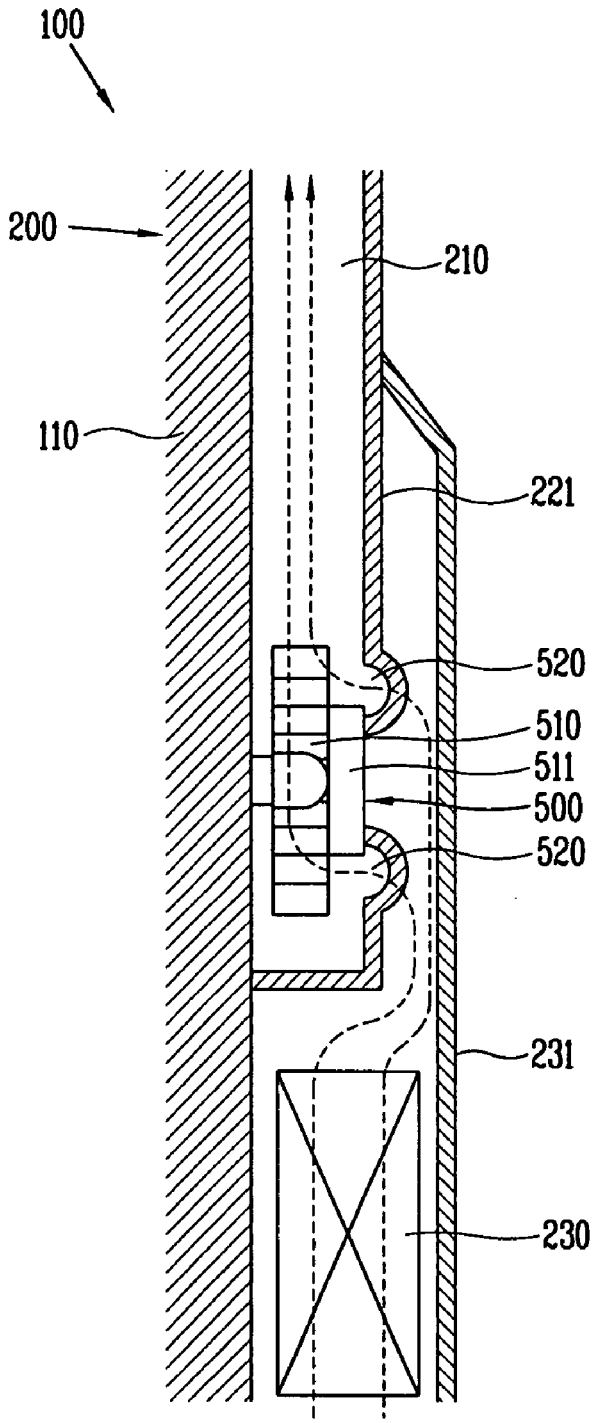
FIG. 5 is a lateral section view of a cool air supplying apparatus for a refrigerator according to another embodiment.

FIG. 4 is a lateral section view of a cool air supplying apparatus for a refrigerator according to another embodiment. FIG. 5 is a lateral section view of a cool air supplying apparatus for a refrigerator according to another embodiment. A cool air supplying apparatus for the refrigerating chamber is the same as a cool air supplying apparatus for the freezing chamber. Hereinafter, only the cool air supplying apparatus for the freezing chamber will be explained for convenience. Further, like elements have like reference numerals and repetitive discussion has been omitted.

As shown in FIG. 4, a cool air supplying apparatus for a refrigerator 100 according to another embodiment comprises an evaporator 230, respectively, provided for a freezing chamber 20 and a refrigerating chamber 30 which are separated from each other by a partition wall 40, that generate cool air, a first cover 231 that receives the evaporator 230 therein, a fan 510 that blows cool air generated from the evaporator 230 to the freezing chamber 20 or the refrigerating chamber 30, a motor 511 that drives the fan 510, a second cover 221 that receives the fan 510 and the motor 511 therein, and an orifice 520 that guides cool air to the fan 510. The fan 510 and the motor 511 may be integrally formed, to thus constitute a box fan motor 500.

The evaporator 230 may be received in the first cover 231. A cool air inlet 24 that introduces increased temperature cool air, which has performed a cooling operation by circulating through the freezing chamber 200 is provided below the first cover 231. An orifice 520 that introduces lowered temperature cool air that has been heat-exchanged by the evaporator 230 to the box fan motor 500 may be formed above the first cover 231. The fan 510 of the box fan motor 500 may be a centrifugal fan.

The box fan motor 500 may be installed above the evaporator 230 or at an upper side of a cool air passage in order to more smoothly supply cool air generated from the evaporator 230 to the freezing chamber 200. Cool air may be supplied to the freezing chamber 200 through a first passage and a second passage. The first passage may be formed by a rear wall 110 and the first cover 231 which covers the rear wall 110. The second passage may be formed by an upper portion of the first cover 231 and the second cover 221 which covers the rear wall 110.

The box fan motor 500 integrally having the fan 510 and the motor 511 may be installed between the upper portion of the first cover 231 where the orifice 520 is formed and the second cover 221. That is, the orifice 520 may be provided in the first cover 231, and may be positioned at one side of the fan 510 and the motor 511 of the box fan motor 500.

The first cover 231 and the second cover 221 may be separated from the rear wall 110 of the freezing chamber 200 by the same distance. That is, a lower portion of the first cover 231 and a lower portion of the second cover 221 may be separated from the rear wall 110 of the freezing chamber 200 by the same distance. In such as case, the second cover 221 would not protrude towards the inside of the freezing chamber 200, and a capacity volume of the freezing chamber 200 would be increased.

A cool air duct 210 for supplying cool air to the freezing chamber 200 may be formed at one end of the second cover 221. Further, a plurality of cool air duct 210 may be installed along a side wall (not shown) of the freezing chamber 200.

Lowered temperature cool air having passed through the evaporator 230 passes through the first passage, and then may be introduced into the orifice 520. Then, the cool air then may be introduced into the second passage via the box fan motor 500.

With the box fan motor 500, the motor 511 does not interrupt the cool air passage, and thus cool air may be directly introduced into the orifice 520. Accordingly, an entire length of the cool air passage may be decreased.

As shown in FIG. 5, a cool air supplying apparatus for a refrigerator 100 according to another embodiment may include a first passage and a second passage. The first passage may be formed by the rear wall 110 of the freezing chamber 200, and the first cover 231 that covers the rear wall 110. The second passage may be partially installed in the first cover 231, and may be formed by the rear wall 110 and the second cover 221 that covers the rear wall 110.

The box fan motor 500 may be installed between the rear wall 110 of the freezing chamber 200 and the second cover 221. The orifice 520 may be formed in the second cover 221 at a rear side of the box fan motor 500. That is, the orifice 520 may be formed in the second cover 221 so as to be positioned at one side of the fan 510 and the motor 511 of the box fan motor 500.

The second cover 221 may be partially positioned in the first cover 231, and the first cover 231 may be separated from the rear wall 110 of the freezing chamber 200 by a gap without protruding towards the freezing chamber 200. Accordingly, a capacity volume of the freezing chamber 200 may be increased.

Further, the box fan motor 500 integrally having the fan 510 and the motor 511 may be installed so that the motor is attached to the rear wall 110. Accordingly, noise and vibration generated when the box fan motor 500 is driven may be prevented from being transmitted outwardly.

A cool air duct 210 that supplies cool air to the freezing chamber 200 may be formed at one end of the second cover 221. Low-temperature cool air having passed through the evaporator 230 passes through the first passage, and then may be introduced into the orifice 520. Then, the cool air may be introduced into the second passage via the box fan motor 500.

With the box fan motor 500, the first passage may not be interrupted by the motor 511, cool air may be directly introduced into the orifice 520, and an entire length of the cool air passage may be shortened.

As set forth above, the refrigerator 100 having a cool air supplying apparatus according to embodiments include a freezing chamber 200, a refrigerating chamber 30 separated from the freezing chamber 200 by a partition wall 40, an evaporator 230 installed at a rear side of the freezing chamber 200 or the refrigerating chamber 30, that generates cool air, a box fan motor integrally having a fan 510 that blows cool air generated from the evaporator 230 to the freezing chamber 200 or the refrigerating chamber 30 and a motor 511 to drive the fan 510, a first passage that supplies cool air generated from the evaporator 230 to the box fan motor 500, and a second passage that supplies cool air blown by the box fan motor 500 to the freezing chamber 200 or the refrigerating chamber 30. In FIGS. 4 and 5, the dotted line arrow denotes a flowing direction of cool air.

Hereinafter, an operation of a refrigerator having a cool air supplying apparatus according to embodiments will be explained.

When power is supplied to the refrigerator, a compressor (not shown) is operated thus to cool the evaporator 230. The increased temperature cool air having been introduced to the cool air inlet 24 of FIG. 2 formed below the evaporator 230 is converted into lowered temperature cool air after being heat-exchanged by the evaporator 230. Then, the cool air is introduced into the box fan motor 500 via the orifice 520.

The cool air having passed through the box fan motor 500 passes through the cool air duct 210, and is introduced into the freezing chamber 200 through a cool air outlet (not shown) provided at the freezing chamber 200, thereby evenly freezing food of the freezing chamber 200.

As shown in FIG. 4, the cool air having passed through the evaporator 230 is introduced into the cool air duct 210 through the first passage between the rear wall 110 and the first cover 231, and the second passage between an upper portion of the first cover 231 and the second cover 221. As shown in FIG. 5, the cool air having passed through the evaporator 230 is introduced into the cool air duct 210 through the first passage between the rear wall 110 and the first cover 231, and the second passage between the rear wall 110 and the second cover 221. Accordingly, the box fan motor 500 does not interrupt the cool air passage, and an entire length of the cool air passage is shortened.

In the aforementioned embodiments, a cool air supplying apparatus for a freezing chamber 200 was explained. However, the cool air supplying apparatus may be utilized for a refrigerating chamber as well.

The cool air supplying apparatus according to embodiments disclosed herein have at least the following advantages.

The cool air supplying apparatus according to embodiments disclosed herein is capable of decreasing a passage resistance of cool air and increasing a capacity of a refrigerator. That is, since the box fan motor integrally having the fan and the motor is used, the motor may not interrupt flow of cool air, thus decreasing energy loss. Further, since the motor does not protrude towards the inside of the refrigerator, a capacity volume of the refrigerator may be increased. Furthermore, since the orifice is installed at one side of the box fan motor not between the fan and the motor, an entire length of the cool air passage may be reduced, thus enhancing efficiency of the refrigerator. Additionally, since the box fan motor is installed in the rear wall of the refrigerator, vibration or noise generated when the box fan motor is driven may be prevented from being transmitted outwardly. Also, since installation and detachment of the box fan motor onto/from the refrigerator is facilitated, a fabrication cost or a maintenance cost for the box fan motor may be reduced.

A cool air supplying structure for a refrigerator according to an embodiment disclosed herein includes a box fan motor integrally having a fan for blowing cool air generated from an evaporator to a freezing chamber or a refrigerating chamber, a motor for driving the fan, a first passage for supplying cool air generated from the evaporator to the box fan motor, and a second passage for supplying cool air blown by the box fan motor to the freezing chamber or the refrigerating chamber. With this structure, a passage resistance of cool air due to the motor may be decreased, and efficiency of the refrigerator enhanced by shortening a cool air passage.

The first passage may be formed by a rear wall of the refrigerator and a first cover that covers the rear wall, and the second passage may be formed by an upper portion of the first cover and a second cover that covers the rear wall. Accordingly, an entire length of the cool air passage may be shortened, and a flow resistance of cool air due to the motor prevented.

The box fan motor may be installed between the first cover and the second cover, and an orifice may be formed at the first cover at a rear side of the box fan motor. That is, the orifice for guiding cool air to the box fan motor may be formed at the first cover. The orifice may be disposed at one side of a fan and a motor of the box fan motor.

The orifice according to embodiments disclosed herein may be positioned at one side of the box fan motor. Accordingly, the motor protruding towards the cool air passage may be prevented from interrupting the cool air passage.

As the orifice may be positioned at one side as the box fan motor, an entire length of the cool air passage generated from the evaporator may be shortened, and thus cool air precisely introduced into the fan.

A lower portion of the first cover and a lower portion of the second cover may be separated from the rear wall by the same distance. Accordingly, the box fan motor may be installed near the rear wall of the refrigerator, and a capacity volume of the refrigerator increased.

A cool air duct for guiding cool air blown to the freezing chamber or the refrigerating chamber may be formed at one end of the second cover. A plurality of cool air ducts may be formed along a side wall of the freezing chamber or the refrigerating chamber.

The first passage may be formed by the rear wall and the first cover that covers the rear wall. The second passage may be formed by the rear wall and the second cover installed in the first cover and covering the rear wall.

The box fan motor may be installed between the rear wall and the second cover, and an orifice may be formed at the second cover at a rear side of the box fan motor. That is, the orifice for guiding cool air to the box fan motor may be formed at the second cover. The orifice may be positioned at one side of a fan and a motor of the box fan motor. Accordingly, a cool air passage formed between the rear wall and the first cover can have a short length, thereby reducing a flow loss of cool air and enhancing efficiency of the refrigerator.

Further, since the box fan motor may be installed between the second cover and the rear wall, noise and vibration generated when the box fan motor is driven may be prevented from being transmitted outwardly.

A refrigerator having a cool air supplying structure according to an embodiment disclosed herein includes a freezing chamber, a refrigerating chamber separated from the freezing chamber by a partition wall, an evaporator installed at a rear side of the freezing chamber or the refrigerating chamber, for generating cool air, a box fan motor integrally having a fan for blowing cool air generated from the evaporator to the freezing chamber or the refrigerating chamber, and a motor for driving the fan, a first passage for supplying cool air generated from the evaporator to the box fan motor, and a second passage for supplying cool air blown by the box fan motor to the freezing chamber or the refrigerating chamber.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is received by the fan from the first passage and blown by the blades of the fan through the second passage, the first passage is formed by a rear wall of the refrigerator and a first cover, the first cover is coupled to a second cover covering the second passage, the second passage is formed by the rear wall and the second cover, an exterior surface of the first cover facing the freezing chamber or cooling chamber is substantially coplanar with an exterior surface of the second cover, and a distance between the rear wall and the first cover is substantially equal to a distance between the rear wall and the second cover, wherein the second passage is formed by an upper portion of the first cover and the second cover and wherein a lower portion of the first cover and a lower portion of the second cover are separated from the rear wall by the same distance.

2. The apparatus of claim 1, wherein at least one cool air duct configured to guide cool air blown to the freezing chamber or the refrigerating chamber is formed at one end of the second cover.

3. The apparatus of claim 2, wherein the at least one cool air duct comprises a plurality of cool air ducts formed along a side wall of the freezing chamber or the refrigerating chamber.

4. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is received by the fan from the first passage and blown by the blades of the fan through the second passage, the first passage is formed by a rear wall of the refrigerator and a first cover, the first cover is coupled to a second cover covering the second passage, the second passage is formed by the rear wall and the second cover, an exterior surface of the first cover facing the freezing chamber or cooling chamber is substantially coplanar with an exterior surface of the second cover, and a distance between the rear wall and the first cover is substantially equal to a distance between the rear wall and the second cover, wherein the second passage is formed by an upper portion of the first cover and the second cover, wherein the second passage is formed by the rear wall and the second cover installed in the first cover, and wherein the box fan motor is installed between the rear wall of the refrigerator and the second cover.

5. The apparatus of claim 4, wherein an orifice configured to guide cool air to the fan is formed in the second cover, and wherein the orifice is formed at one side of the fan.

6. The apparatus of claim 4, wherein at least one cool air duct configured to guide cool air blown to the freezing chamber or the refrigerating chamber is formed at one end of the second cover.

7. The apparatus of claim 6, wherein the cool air duct comprises a plurality of cool air ducts formed along a side wall of the freezing chamber or the refrigerating chamber.

8. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is received by the fan from the first passage and blown by the blades of the fan through the second passage, the first passage is formed by a rear wall of the refrigerator and a first cover, the first cover is coupled to a second cover covering the second passage, the second passage is formed by the rear wall and the second cover, an exterior surface of the first cover facing the freezing chamber or cooling chamber is substantially coplanar with an exterior surface of the second cover, and a distance between the rear wall and the first cover is substantially equal to a distance between the rear wall and the second cover, wherein the second passage is formed by an upper portion of the first cover and the second cover and wherein the box fan motor is installed between the first cover and the second cover.

9. The apparatus of claim 8, wherein an orifice configured to guide cool air to the fan is formed in the first cover, and wherein the orifice is formed at one side of the fan.

10. A refrigerator comprising the cool air supplying apparatus of claim 1.

11. The apparatus of claim 1, wherein the box fan motor is not included in an air flow path that extends from the first passage to the second passage.

12. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is received by the fan from the first passage and blown by the blades of the fan through the second passage, the first passage is formed by a rear wall of the refrigerator and a first cover, the first cover is coupled to a second cover covering the second passage, the second passage is formed by the rear wall and the second cover, an exterior surface of the first cover facing the freezing chamber or cooling chamber is substantially coplanar with an exterior surface of the second cover, and a distance between the rear wall and the first cover is substantially equal to a distance between the rear wall and the second cover, wherein the box fan motor is separated from the air flow path by one or more orifices that direct air in the air flow path around the box fan motor.

13. The apparatus of claim 12, wherein the rear wall maintains at least a substantially straight profile throughout all or substantially all of at least one of the freezing or refrigerating chambers.

14. The apparatus of claim 13, wherein the fan and box fan motor are located between the second cover and the rear wall of the refrigerator, and wherein the fan is located between the rear wall of the refrigerator and the box fan motor.

15. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is received by the fan from the first passage and blown by the blades of the fan through the second passage, the first passage is formed by a rear wall of the refrigerator and a first cover, the first cover is coupled to a second cover covering the second passage, the second passage is formed by the rear wall and the second cover, an exterior surface of the first cover facing the freezing chamber or cooling chamber is substantially coplanar with an exterior surface of the second cover, and a distance between the rear wall and the first cover is substantially equal to a distance between the rear wall and the second cover, wherein:

a wall separates at least a portion of the box fan motor from the evaporator, the wall including a first hole and a second hole, and cool air from the evaporator flows into the blades of the fan through the first hole and cool air from the evaporator flows into the second passage through the second hole without passing through the blades of the fan.

16. The apparatus of claim 15, wherein the first hole is closer to the evaporator than the second hole.

17. The apparatus of claim 15, wherein the first cover covers the evaporator and the second cover covers at least a portion of the blades of the fan, wherein the wall which includes the first and second holes projects from one of the first cover or the second cover inwardly towards the freezing chamber or refrigerating chamber.

18. The apparatus of claim 17, wherein the second cover is in alignment with at least one of the first or second holes.

19. A cool air supplying apparatus for a refrigerator, comprising:

a box fan motor having a fan configured to blow cool air generated from an evaporator to a freezing chamber or a refrigerating chamber;

a first passage configured to supply cool air generated from the evaporator to the fan; and a second passage configured to supply cool air blown by the fan to the freezing chamber or the refrigerating chamber, wherein:

the fan is a centrifugal fan, blades of the fan extend in a direction that is substantially parallel to an axis of the motor coupled to the fan and substantially perpendicular to a direction in which air is blown by the blades of the fan through the second passage, the first passage is formed by a rear wall of the refrigerator and a second cover, the second cover is coupled to a first cover covering the second passage, at least a portion of the first cover is between the rear wall and the second cover, the second passage is formed by the rear wall and the first cover, air from the first passage flows into the blades of the fan through at least one hole in the first cover, the air flowing into the at least one hole through a space between the first cover and the second cover, wherein:

a distance between the rear wall and the first cover is less than a distance between the rear wall and the second cover, the distance between the rear wall and the second cover is substantially same from a first point which is coincident with an axis that passes through the evaporator and a second point, the second cover is coupled to the first cover, and the blades of the fan are located between the first point and the second point.

20. The apparatus of claim 19, wherein:

air from the first passage flows to the fan through first and second holes in the first cover, the first and second holes located on respective sides of the fan, and the air flowing to the first and second holes through a space between the first and the second covers.

21. The apparatus of claim 20, wherein edges of the first and second holes contact the box fan motor.

22. The apparatus of claim 20, wherein air in the first and second passages flows along paths located on a common axis that passes through the first and second passages.

23. The apparatus of claim 1, wherein air in the first and second passages flows along paths located on a common axis that passes through the first and second passages.

* * * * *